US010022587B1

(12) United States Patent
Wu et al.

(10) Patent No.: US 10,022,587 B1
(45) Date of Patent: Jul. 17, 2018

(54) WALKING TRAINER

(71) Applicant: HIWIN TECHNOLOGIES CORP., Taichung (TW)

(72) Inventors: Yi-Jing Wu, Taichung (TW); Wen-Bin Lin, Taichung (TW)

(73) Assignee: HIWIN TECHNOLOGIES CORP., Taichung (TW)

( * ) Notice: Subject to any disclaimer, the term of this patent is extended or adjusted under 35 U.S.C. 154(b) by 0 days.

(21) Appl. No.: 15/477,683

(22) Filed: Apr. 3, 2017

(51) Int. Cl.

| | |
|---|---|
| ***A63B 22/04*** | (2006.01) |
| ***A63B 22/00*** | (2006.01) |
| ***A63B 21/008*** | (2006.01) |
| ***A61H 1/02*** | (2006.01) |
| *A63B 22/06* | (2006.01) |
| *A61H 1/00* | (2006.01) |

(52) U.S. Cl.
CPC ..... *A63B 22/0056* (2013.01); *A61H 1/0262* (2013.01); *A63B 21/0083* (2013.01); *A61H 1/00* (2013.01); *A63B 22/0015* (2013.01); *A63B 22/0023* (2013.01); *A63B 22/0061* (2013.01); *A63B 22/0605* (2013.01); *A63B 2022/0038* (2013.01); *A63B 2208/0204* (2013.01)

(58) Field of Classification Search
CPC ..... A63B 22/0015; A63B 22/0017; A63B 22/0023; A63B 22/0025; A63B 22/0056; A63B 22/0061; A63B 2022/002; A63B 2022/0028; A63B 2022/003; A63B 2022/0033; A63B 2022/0038; A63B 2208/0204; A61H 1/02; A61H 1/0262
See application file for complete search history.

(56) References Cited

U.S. PATENT DOCUMENTS

| | | | | |
|---|---|---|---|---|
| 6,572,514 B1 * | 6/2003 | Calafato | ..... | A63B 22/0056 482/79 |
| 7,955,225 B1 * | 6/2011 | James | ..... | A63B 22/0664 482/51 |
| 2011/0152036 A1 * | 6/2011 | Halver | ..... | A63B 21/157 482/51 |
| 2014/0100491 A1 * | 4/2014 | Hu | ..... | A61H 3/008 601/27 |

(Continued)

FOREIGN PATENT DOCUMENTS

| | | | |
|---|---|---|---|
| CN | 105167959 | A | 12/2015 |
| JP | 2001-309993 | A | 11/2001 |
| JP | 2002-325860 | A | 11/2002 |

*Primary Examiner* — Joshua Lee
(74) *Attorney, Agent, or Firm* — Muncy, Geissler, Olds & Lowe, P.C.

(57) ABSTRACT

A walking trainer includes a linear transmission unit including two carriages, and two pedal units each including a pedal holder, which includes a bottom frame carried on one respective carriage, upright posts mounted at the bottom frame and a top block mounted on and movable up and down along the upright posts, a rotary shaft mounted in the top block in a direction perpendicular to the upright posts and a pedal mounted on the rotary shaft and biasable with the rotary shaft relative to the pedal holder. Thus, the pedals of the pedal units can be moved with the respective carriages linearly and alternatively back and forth, on the other hand, and can also be moved with the associating top blocks up and down and biased with the respective rotary shafts relative to the respective pedal holders to simulate the walking gait path.

10 Claims, 9 Drawing Sheets

(56) References Cited

U.S. PATENT DOCUMENTS

| | | | | |
|---|---|---|---|---|
| 2014/0371640 | A1* | 12/2014 | Schorgendorfer ... | A61H 1/0262<br>601/35 |
| 2016/0213972 | A1* | 7/2016 | Waldner ..... | A61H 1/0262 |

* cited by examiner

WALKING TRAINER

BACKGROUND OF THE INVENTION

1. Field of the Invention

The present invention relates to walking training machines and more particularly, to a walking trainer, which enables the user to accurately simulate the walking gait path.

2. Description of the Related Art

Walking must rely on the coordination of the nerves, muscles and bones of the body so that the body can move forward. Achieving steady walking needs to have enough attention, muscle strength and appropriate action control. Decline in physical function is a common feature of older age and has important outcomes in terms of walking disorder, falls, and decline in physical health-related quality of life.

In order to help the elderly implement rehabilitation training, various training machines have been created. For example, JP2002325860 discloses a walking machine, which provides a first leg-part mounting device and a second leg-part mounting device for back-and-forth motion in an alternative manner to achieve leg training. JP2001309993 discloses a training machine in which track sliding is implemented for causing the pedal to move alternatively back and forth. CN105167959 discloses a multi-function gait rehabilitation trainer, which utilizes sliding blocks to carry the pedals alternatively back and forth, provides pins for enabling the pedals to achieve biasing. However, the aforesaid various prior art designs cannot enable the pedals to accurately simulate the motion trajectory in walking, resulting in reduced training effects.

SUMMARY OF THE INVENTION

The present invention has been accomplished under the circumstances in view. It is the main object of the present invention to provide a walking trainer, which enables the user to effectively simulate the walking gait path, enhancing the effectiveness of rehabilitation training.

To achieve this and other objects of the present invention, a walking trainer comprises a linear transmission unit and two pedal units. The linear transmission unit comprises a support base, a drive source mounted in the support base, two screw rods mounted in the support base in a substantially parallel manner and coupled to and rotatable by the drive source, and two carriages respectively threaded onto the two screw rods and alternatively movable back and forth along the respective screw rods one after the other upon rotation of the screw rods. The two pedal units each comprise a pedal holder, a rotary shaft and a pedal. The pedal holder comprises a bottom frame, a top block and a plurality of upright posts. The bottom frame has a bottom wall thereof fastened to one respective carriage of the linear transmission unit. The upright posts are mounted at a top side of the bottom frame and spaced out. The top block is mounted on the upright posts and movable up and down along the upright posts. The rotary shaft is rotatably mounted on the top block in a direction perpendicular to the extending direction of the upright posts. The pedal is mounted on the rotary shaft and biasable with the rotary shaft relative to the pedal holder.

Thus, subject to the connection relationship between the pedal holders and the respective carriages, the pedals can be alternatively and horizontally moved back and forth. Further, during horizontal movement of the pedals, the pedals can be moved up and down with the top blocks of the respective pedal holders and biased relative to the respective pedal holders to mate with action changes of the soles of the user's feet in walking, so that the user can effectively simulate the walking gait path, enhancing the effectiveness of rehabilitation training.

Preferably, the top block of the pedal holder of each pedal unit is movable up and down along the associating upright posts relative to the associating bottom frame within a distance of 5 centimeters, and, the pedal of each pedal unit is biasable relative to the associating pedal holder within a 10-degree angle.

Preferably, the walking trainer further comprises a lifting unit. The lifting unit comprises a base frame adapted to be positioned on the ground, a platform base fastened to a bottom wall of the support base of the linear transmission unit and having a rear end thereof supported on the ground, a lifting base having opposing front and rear ends thereof respectively pivotally connected to a front end of the base frame and an opposing front end of the platform base, and a lifting actuator coupled between the front end of the lifting base and the opposing front end of the platform base. Thus, the lifting base can utilize the lifting actuator to lift the platform base and the linear transmission unit to a predetermined tilt angle, showing an effect of walking in a slope.

Preferably, the lifting unit further comprises a storage actuator coupled between the base frame and the platform base and spaced from the lifting actuator at a predetermined distance, and adapted for lifting the rear end of the platform base from the ground to achieve a storage effect.

Other advantages and features of the present invention will be fully understood by reference to the following specification in conjunction with the accompanying drawings, in which like reference signs denote like components of structure.

DETAILED DESCRIPTION OF THE INVENTION

Figure 1:
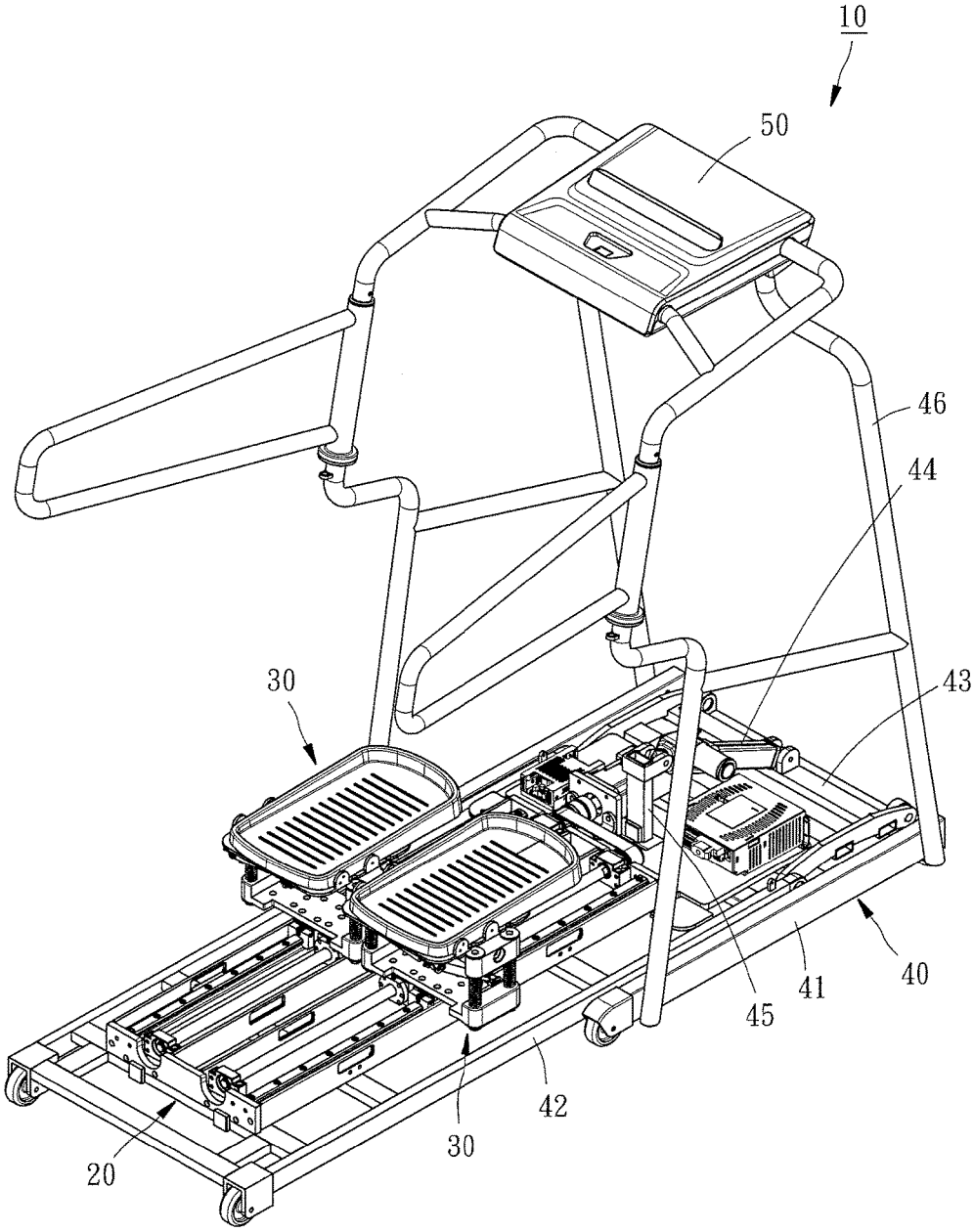
FIG. 1 is an oblique top elevational view of a walking trainer in accordance with the present invention.

Referring to FIG. 1, a walking trainer 10 in accordance with the present invention is shown. The walking trainer 10 comprises a linear transmission unit 20 and two pedal units 30.

Figure 2:
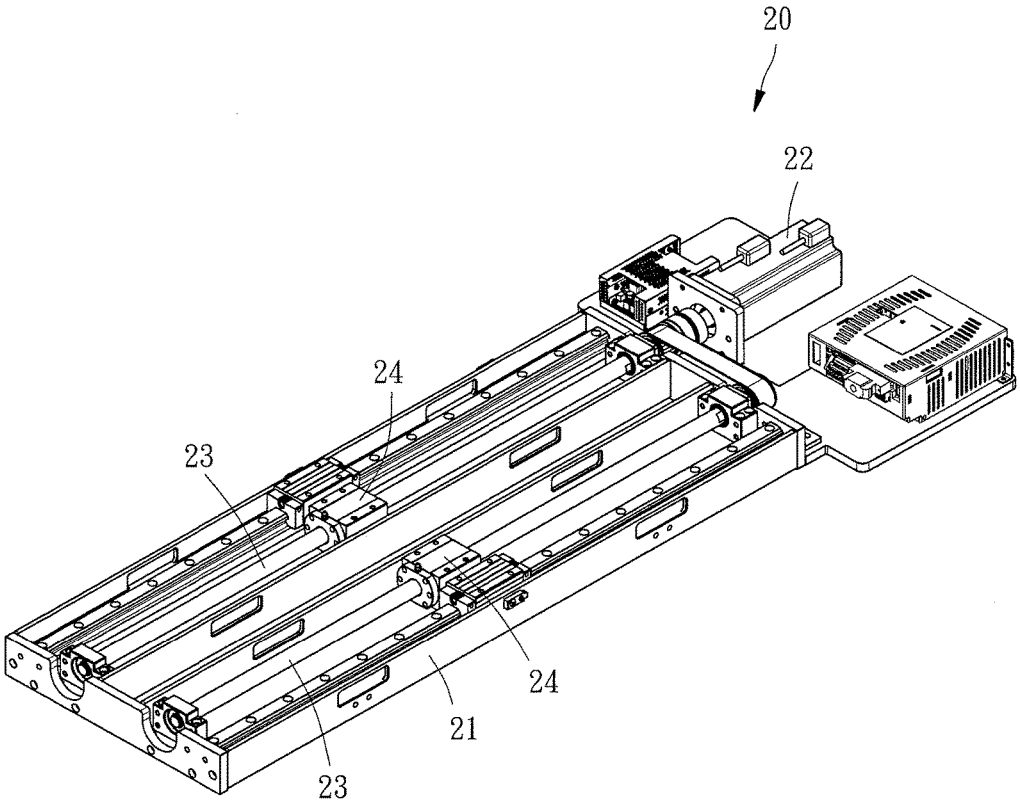
FIG. 2 is an oblique top elevational view of the linear transmission unit of the walking trainer in accordance with the present invention.

Referring FIG. 2, the linear transmission unit 20 comprises a support base 21, a drive source 22, two screw rods 23 and two carriages 24. The drive source 22 is mounted in a top side of the support base 21. The two screw rods 23 are mounted in the top side of the support base 21 in a substantially parallel manner and respectively connected to the drive source 22 so that the two screw rods 23 are rotatable by the drive source 22. The two carriages 24 are respectively threaded onto the screw rods 23 in such a manner that rotating the two screw rods 23 can cause the two carriages 24 to reciprocate along the respective screw rods 23 one after the other.

Figure 3:
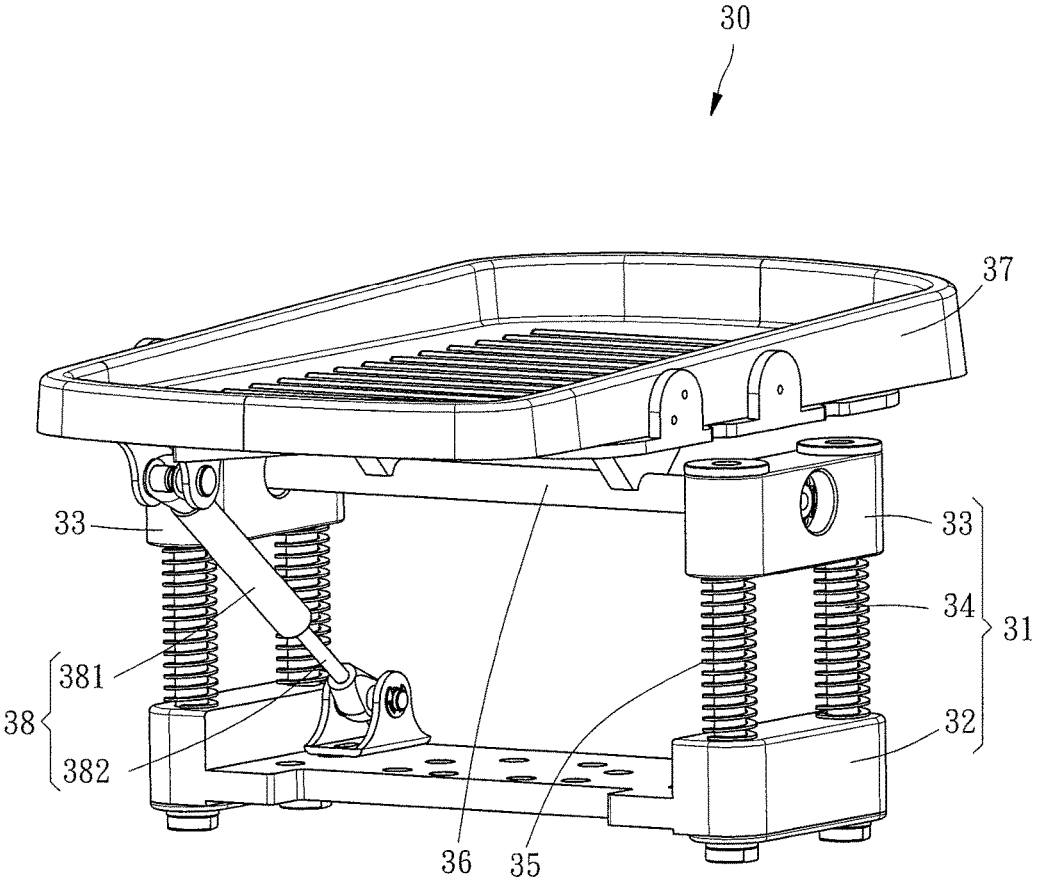
FIG. 3 is an oblique top elevational view of one pedal unit of the walking trainer in accordance with the present invention.

Referring to FIG. 3, each pedal unit 30 comprises a pedal holder 31, 4 first buffer members 35, a rotary shaft 36, a pedal 37, and a second buffer member 38.

Figure 6:
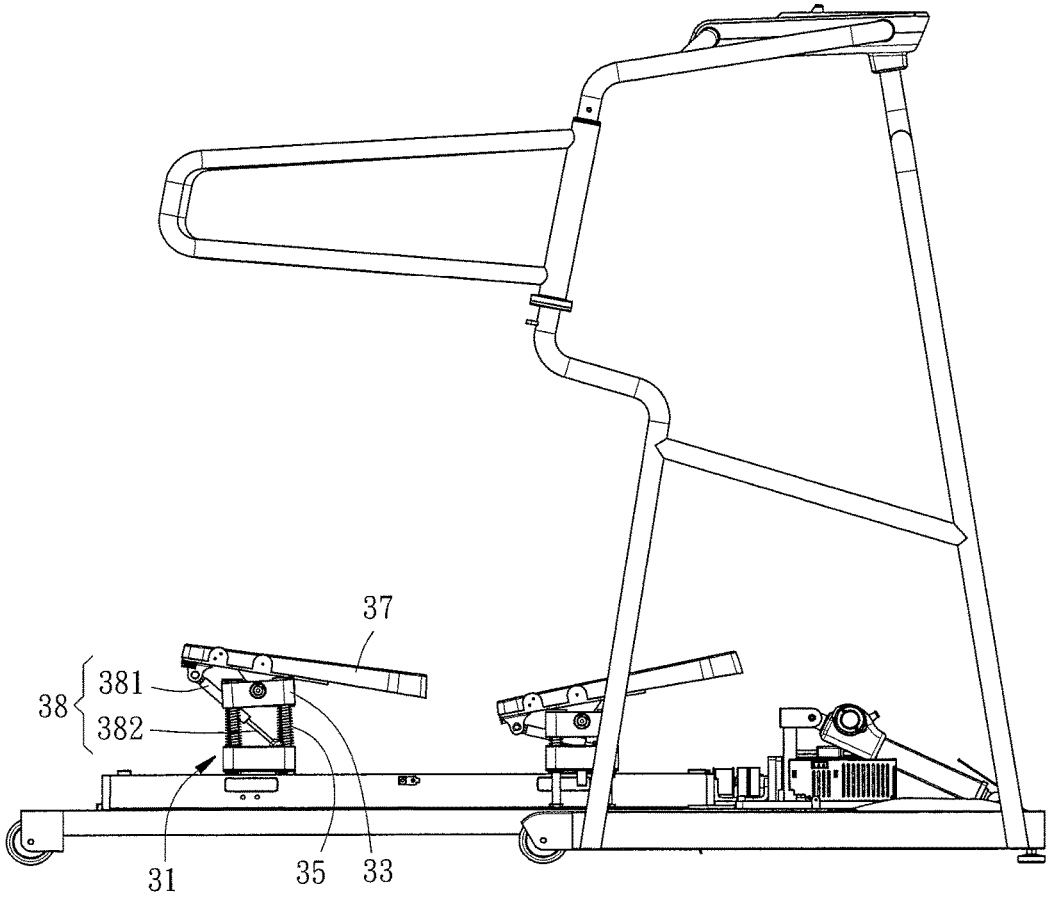
FIG. 6 is a side view of the present invention, illustrating the walking trainer set for the straight walking mode.

The pedal holder 31 comprises a bottom frame 32, two top blocks 33 and four upright posts 34. The bottom frame 32 is fastened with a bottom wall thereof to a top wall of one respective carriage 24 of the linear transmission unit 20. The four upright posts 34 are arranged in two pairs and bilaterally mounted at a top side of the bottom frame 32. The two top blocks 33 are respectively and vertically movably mounted on the two pairs of upright posts 34. Thus, the pedal holder 31 can be moved synchronously with the respective carriage 24, and, the top blocks 33 of the pedal holder 31 can be moved up and down relative to the bottom frame 32 of the pedal holder 31, as illustrated in FIG. 6. In the present preferred embodiment, the moving range of the top blocks 33 relative to the bottom frame 32 is within 5 centimeters.

The first buffer members 35 are mounted on the pedal holder 31 between the bottom frame 32 and the top blocks 33 to exert a buffering effect against the vertical displacement of the two top blocks 33, as illustrated in FIG. 6. In the present preferred embodiment, the first buffer members 35 are spring members respectively sleeved onto the upright posts 34 and stopped between the bottom frame 32 and the respective top blocks 33.

The rotary shaft 36 is rotatably mounted between the two top blocks 33 of the pedal holder 31. Further, the axial direction of the rotary shaft 36 is perpendicular to the axial direction of the upright posts 34.

The pedal 37 is mounted on the associating rotary shaft 36 so that the pedal 37 can be biased relative to the pedal holder 31 by means of the associating rotary shaft 36, as illustrated in FIG. 6. In the present preferred embodiment, the pedal 37 can be biased relative to the pedal holder 31 within a 10-degree angle.

The second buffer member 38 is mounted between the bottom frame 32 of the pedal holder 31 and the pedal 37, and to exert a buffering effect against the biasing of the pedal 37, as illustrated in FIG. 6. In the present preferred embodiment, the second buffer member 38 is a pressure cylinder comprising a cylinder body 381 and a piston rod 382 axially movable in and out of the cylinder body 381. The cylinder body 381 has one end thereof pivotally connected to the pedal 37. The piston rod 382 has one end thereof cylinder body 381 axially movably mounted in the cylinder body 381, and an opposite end thereof disposed outside the cylinder body 381 and pivotally connected to the bottom frame 32 of the pedal holder 31.

Figure 5:
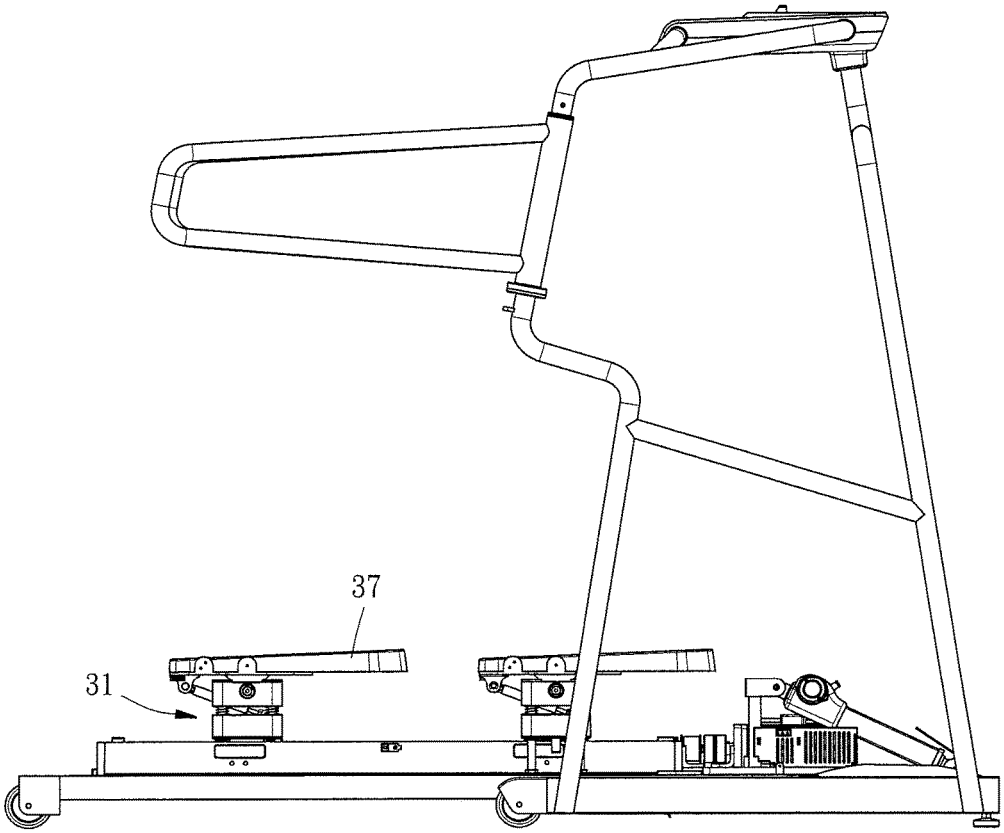
FIG. 5 is a side view of the present invention, illustrating the walking trainer set for the linear sliding mode.

As illustrated in FIGS. 2, 3 and 5, subject to the connection relationship between the pedal holders 31 and the respective carriages 24, the pedals 37 can be alternatively and horizontally moved back and forth. Further, during horizontal movement of the pedals 37, as illustrated in FIG. 6, the pedals 37 can be moved up and down with the top blocks 33 of the respective pedal holders 31 and biased relative to the respective pedal holders 31 to mate with action changes of the soles of the user's feet in walking, so that the user can effectively simulate the walking gait path, enhancing the effectiveness of rehabilitation training.

Figure 4:
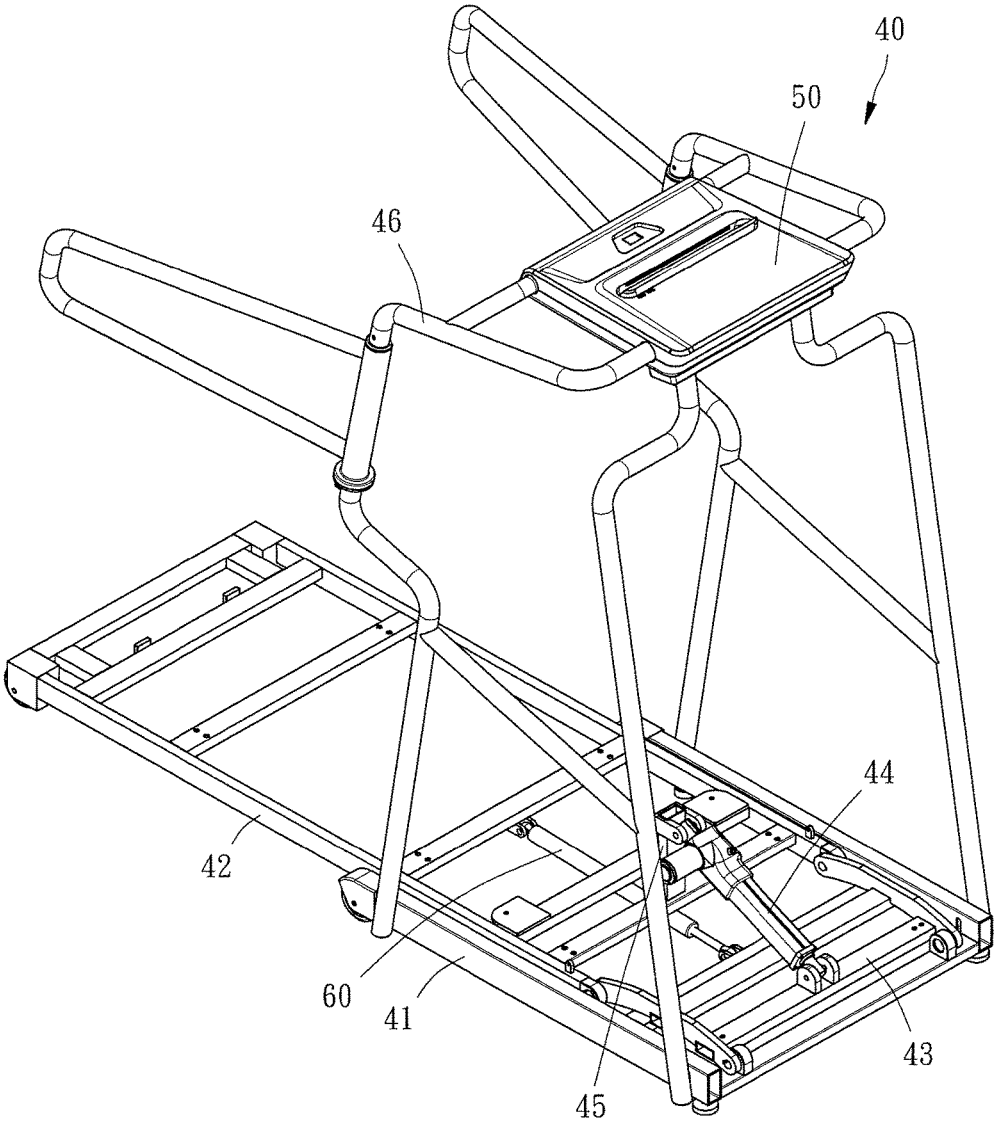
FIG. 4 is an oblique top elevational view of the lifting unit of the walking trainer in accordance with the present invention.
Figure 7:
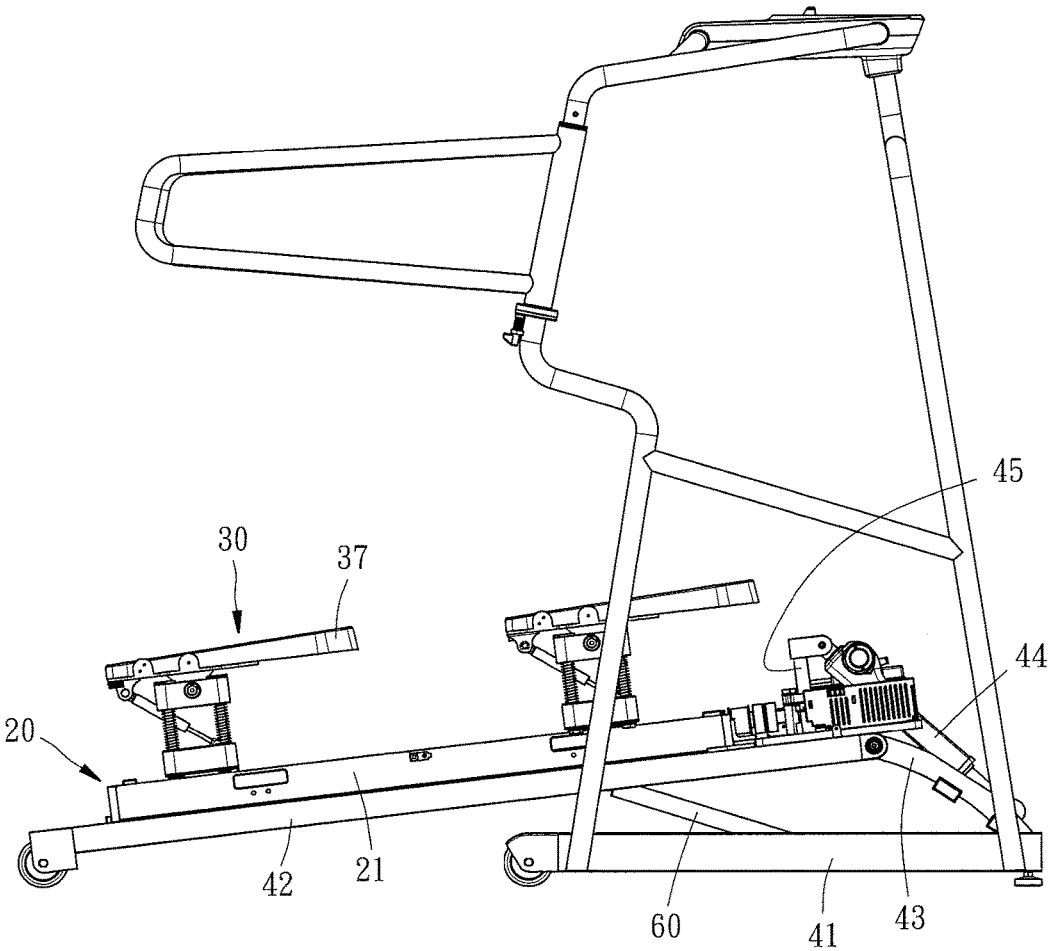
FIG. 7 is a side view of the present invention, illustrating the walking trainer set for the slope sliding mode.
Figure 8:
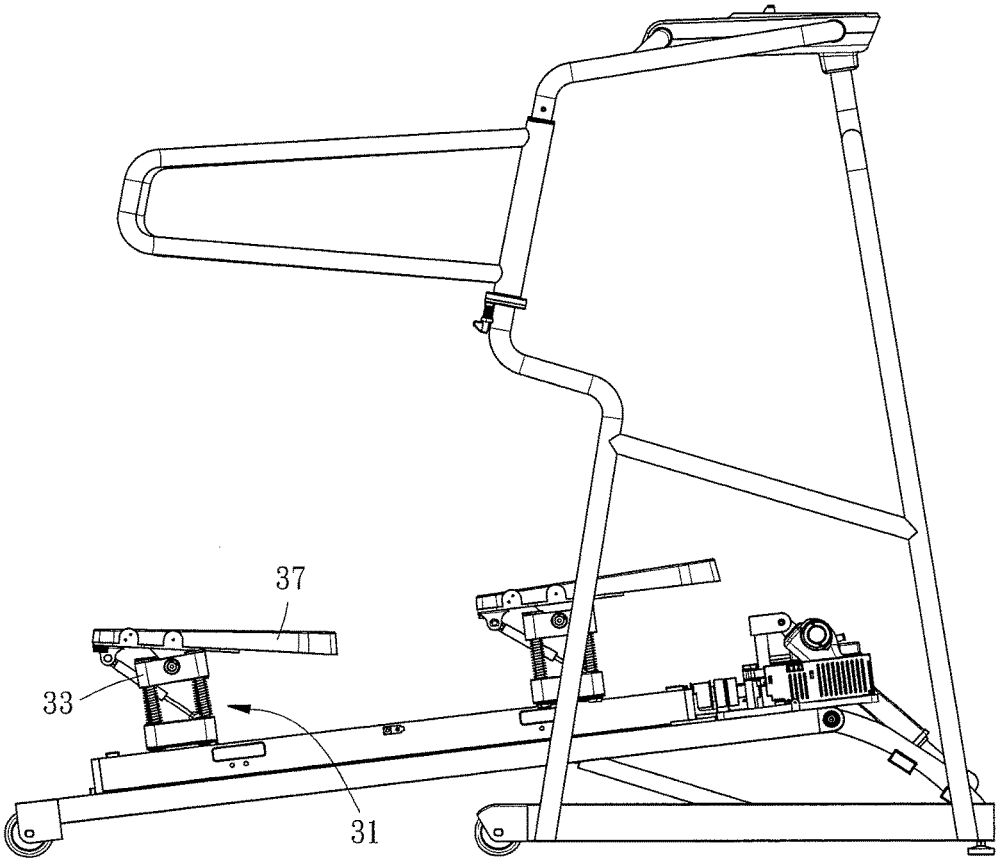
FIG. 8 is a side view of the present invention, illustrating the walking trainer set for the slope walking mode.

On the other hand, in order to simulate the effect of walking in a slope, the invention further provides a lifting unit 40, as illustrated in FIG. 4. The lifting unit 40 comprises a base frame 41, a platform base 42, a lifting base 43, and a lifting actuator 44. The base frame 41 is adapted to be positioned on the ground. The platform base 42 is fastened to a bottom wall of the support base 21 of the linear transmission unit 20 with a rear end thereof supported on the ground. The lifting base 43 has opposing front and rear ends thereof respectively pivotally connected to a front end of the base frame 41 and an opposing front end of the platform base 42. The lifting actuator 44 has a top end thereof pivotally connected to the front end of the platform base 42 through an upright stanchion 45, and an opposing bottom end thereof pivotally connected to the front end of the lifting base 43. Thus, as illustrated in FIGS. 7 and 8, when the lifting actuator 44 is started up, it drives the upright stanchion 45 to push the front end of the platform base 42, thereby lifting the front end of the platform base 42. When the front end of the platform base 42 is being lifted, it causes the rear end of the lifting base 43 to be lifted up synchronously. During the upward lifting of the front end of the platform base 42, on the one hand, the rear end of the lifting base 43 is pulled up and the rear end of the lifting base 43 is synchronously lifted upwardly, on the other hand, the linear transmission unit 20 and the pedal unit 30 are caused to produce an angle of inclination with respect to the ground, and the lifting actuator 44 is turned off after the adjustment to the expected appropriate angle. Thus, the pedals 37 not only can be linearly and alternatively moved back and forth on the support base 21 of the linear transmission unit 20 at the inclined base frame 41 of the lifting unit 40 (see FIG. 7) but also can be moved up and down with the respective top blocks 33 relative to the respective pedal holders 31 and biased with the respective rotary shafts 36 relative to the respective pedal holders 31 to mate with action changes of the soles of the user's feet in walking in a slope (see FIG. 8).

Further, the lifting unit 40 comprises a handrail 46 to be grasped by the user's hands so as to provide support. The handrail 46 has a bottom side thereof fastened to the base frame 41, and an opposing top side thereof provided with a human-machine interface 50. The user can operate the human-machine interface 50 to control the operation of the linear transmission unit 20, such as setting the training time, adjusting the running speed and the length of the pace, etc., and also to display the elated physiological information such as walking distance, heart rate, consumption of calories and etc.

Figure 9:
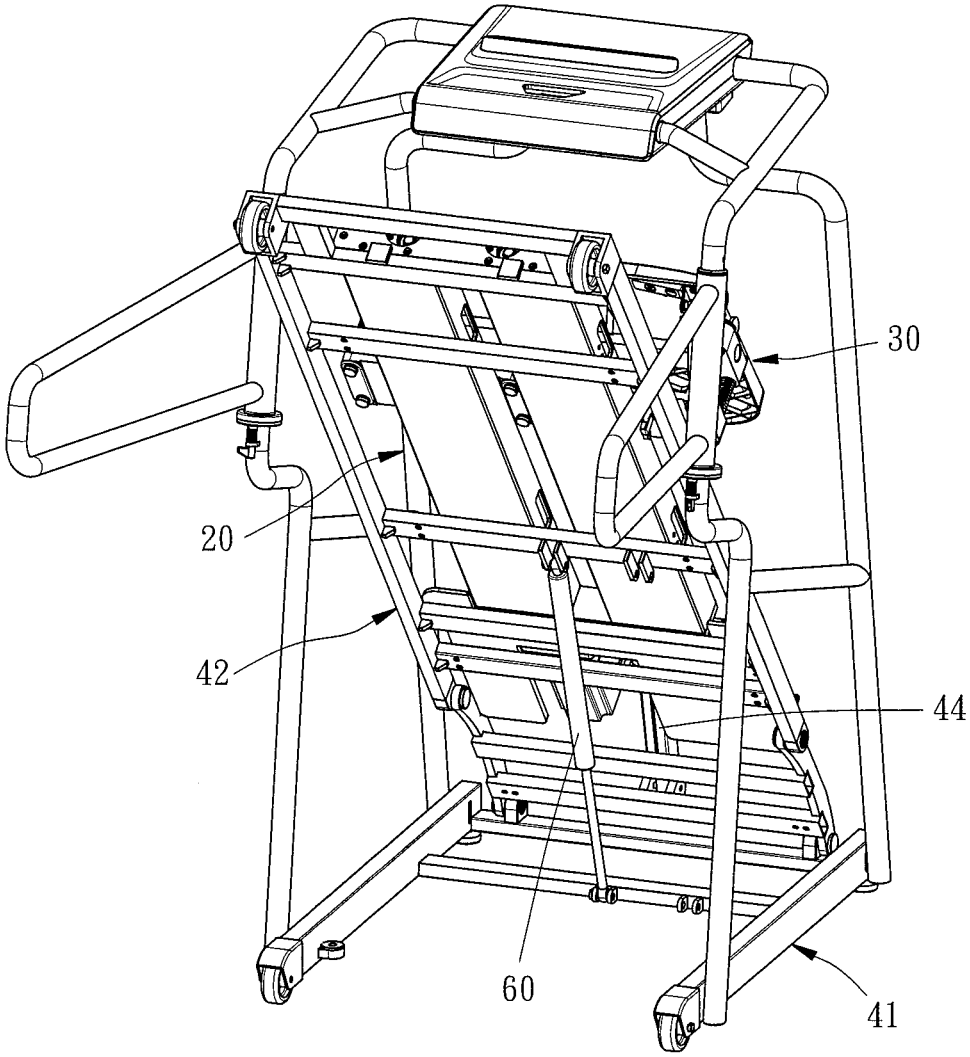
FIG. 9 is an oblique top elevational view of the present invention, illustrating the walking trainer collapsed for storage.

Referring to FIGS. 7 and 9, in order to reduce the volume so as to save storage space when not in use, the invention further provides a storage actuator 60. The storage actuator 60 is mounted between the base frame 41 and the platform base 42, and spaced from the lifting actuator 44 at a predetermined distance. Thus, when the storage actuator 60 is started up, it lifts the rear end of the platform base 42 from the ground. At this time, the linear transmission unit 20 and the pedal units 30 are tilted with the platform base 42, achieve storage efficiency.

In conclusion, the walking trainer 10 of the present invention provides four different operation modes, i.e., the linear sliding mode, the straight walking mode, the slope sliding mode and the slope walking mode, enabling the user to accurately simulate gait changes under different conditions. Further, first and second buffer members 35,38 are provided to the pedals 37 to avoid ankle injuries. Further, the walking trainer 10 is collapsible to enhance storage convenience.

What is claimed is:

1. A walking trainer, comprising:

a linear transmission unit comprising a support base, a drive source mounted in said support base, two screw rods mounted in said support base in a substantially parallel manner and coupled to and rotatable by said drive source, and two carriages respectively threaded onto said two screw rods and alternatively movable back and forth along the respective said screw rods one after the other upon rotation of said screw rods; and two pedal units each comprising a pedal holder, a rotary shaft and a pedal, said pedal holder comprising a bottom frame, a top block and a plurality of upright posts, said bottom frame having a bottom wall thereof fastened to one respective said carriage of said linear transmission unit, said upright posts being mounted at a top side of said bottom frame and spaced out, said top block being mounted on said upright posts and movable up and down along said upright posts, said rotary shaft being rotatably mounted on said top block in a direction perpendicular to the extending direction of said upright posts, said pedal being mounted on said rotary shaft and biasable with said rotary shaft relative to said pedal holder.

2. The walking trainer as claimed in claim 1, wherein said top block of said pedal holder of each said pedal unit is movable up and down along the associating said upright posts relative to the associating said bottom frame within a distance of 5 centimeters.

3. The walking trainer as claimed in claim 1, wherein said pedal of each said pedal unit is biasable relative to the associating said pedal holder within a 10-degree angle.

4. The walking trainer as claimed in claim 1, further comprising a lifting unit, said lifting unit comprising a base frame adapted to be positioned on the ground, a platform base fastened to a bottom wall of said support base of said linear transmission unit and having a rear end thereof supported on the ground, a lifting base having opposing front and rear ends thereof respectively pivotally connected to a front end of said base frame and an opposing front end of said platform base, and a lifting actuator coupled between the front end of said lifting base and the opposing front end of said platform base.

5. The walking trainer as claimed in claim 4, wherein said lifting unit further comprises a storage actuator coupled between said base frame and said platform base and spaced from said lifting actuator at a predetermined distance.

6. The walking trainer as claimed in claim 4, wherein said lifting unit further comprises a handrail, said handrail having a bottom side thereof fastened to said base frame.

7. The walking trainer as claimed in claim 1, wherein each said pedal unit further comprises a first buffer member mounted between the said bottom frame and said top block of the associating said pedal holder and adapted for exerting a buffering effect against the vertical displacement of the associating said top block.

8. The walking trainer as claimed in claim 7, wherein said first buffer member comprises at least one spring member mounted around the associating said upright posts and stopped between the said bottom frame and said top block of the associating said pedal holder.

9. The walking trainer as claimed in claim 1, wherein each said pedal unit further comprises a second buffer member mounted between the said bottom frame of the associating said pedal holder and the associating said pedal and adapted for exerting a buffering effect against the biasing of the associating said pedal.

10. The walking trainer as claimed in claim 9, wherein said second buffer member is a pressure cylinder, said pressure cylinder comprising a cylinder body and a piston rod axially movably mounted in said cylinder body, said cylinder body having one end thereof pivotally connected to the associating said pedal, said piston rod having one end thereof disposed inside said cylinder body and an opposite end thereof disposed outside said cylinder body and pivotally connected to the said bottom frame of the associating said pedal holder.

* * * * *